US006092909A

United States Patent [19]

Sools et al.

[11] Patent Number: 6,092,909

[45] Date of Patent: Jul. 25, 2000

[54] ROAD MARKING UNIT AND ROAD MARKING SYSTEM CAPABLE OF SWITCHING FROM REFLECTIVE STATE TO LIGHT ABSORBING STATE

[75] Inventors: Franciscus G. P. Sools, Eindhoven; Alexander V. Henzen; Reinder Smid, both of Heerlen, all of Netherlands

[73] Assignee: U.S. Philips Corporation, New York, N.Y.

[21] Appl. No.: 09/233,841

[22] Filed: Jan. 20, 1999

[30] Foreign Application Priority Data

Jan. 22, 1998 [EP] European Pat. Off. ..... 98200166

[51] Int. Cl.[7] ..... E01F 9/00; F21V 7/04; F21V 5/00; F21V 7/00

[52] U.S. Cl. ..... 362/153.1; 362/551; 362/559; 362/561; 362/327; 362/341

[58] Field of Search ..... 362/551, 558, 362/559, 561, 153.1, 327, 328, 329, 341

[56] References Cited

U.S. PATENT DOCUMENTS 4,623,222 11/1986 Itoh et al. ..... 349/195
4,783,598 11/1988 McAdams, Jr. ..... 250/566
5,253,109 10/1993 O'Farrell et al. ..... 359/604
5,406,414 4/1995 O'Farrell et al. ..... 359/604
5,686,979 11/1997 Weber et al. ..... 349/96
5,839,816 11/1998 Varga et al. ..... 362/153.1

FOREIGN PATENT DOCUMENTS 2159559 of 1985 United Kingdom ..... E01F 9/06

OTHER PUBLICATIONS

T. Uchida "Reflective LCDs for Low Power Systems" SID 96 Digest, pp. 31–34.

*Primary Examiner*—Sandra O'Shea
*Assistant Examiner*—Bryan P. Stanley
*Attorney, Agent, or Firm*—F. Brice Faller

[57] ABSTRACT

A road marking unit (1) according to the invention comprises a house (10) with a light transmissive window (20). In the house (10) is arranged an electro-optic switch (30). In an activated state of the road marking unit (1) the electro-optic switch (30) achieves that light is reflected from the window (20) back to the window (20). In a de-activated state of the road marking unit (1) the electro-optic switch (30) achieves that light from the window (20) is absorbed. The road marking unit (1) of the invention has the advantage that it can also in bright environmental light it can be switched between visible and invisible.

7 Claims, 3 Drawing Sheets

ROAD MARKING UNIT AND ROAD MARKING SYSTEM CAPABLE OF SWITCHING FROM REFLECTIVE STATE TO LIGHT ABSORBING STATE

BACKGROUND OF THE INVENTION

The invention relates to a road marking unit comprising a housing with a light-transmitting window. The invention also relates to a road marking system.

Such a road marking system is known from GB 2 159 559. In the known road marking unit, light waveguides constructed as glass fibers are provided in the housing, first ends of said waveguides being directed towards the window and second ends thereof being optically coupled to a light source or to a reflector. Such a road marking unit may serve to distinguish individual driving lanes of a road from one another. It is desirable to have a possibility to render the road marking unit visible or invisible in dependence on the ambient conditions. The known road marking unit, in which the second ends of the light waveguides are coupled to a light source, can be made visible or invisible in the case of weak ambient light in that the light source is switched on or off. During the day, in particular in direct sunlight, however, the ambient light is so strong that it drowns out the light originating from the road marking unit. It is not possible then to influence the visibility of the road marking unit.

SUMMARY OF THE INVENTION

It is an object of the invention to provide a road marking unit of which the visibility in direct sunlight can be influenced. According to the invention, an electro-optical switch is accommodated in the housing, which in an activated state reflects light from the window back towards the window, and in a deactivated state of the road marking unit absorbs light from the window. The road marking unit will reflect more light in proportion as there is more ambient light in the activated state, so that the road marking unit will be visible also in strong ambient light, such as direct sunlight. In the deactivated state, the light traversing the window is absorbed, so that the road marking unit is clearly less visible.

The electro-optical switch may be connected to a supply and to switching means arranged at a distance from the road marking unit by means of a cable. In a favorable embodiment of the road marking unit according to the invention, a receiver for remote control of the electro-optical switch is accommodated in the housing, and, in addition, a solar cell is arranged in the housing for supplying power to the receiver and the electro-optical switch. An external cable is redundant in this embodiment, which simplifies the installation of the road marking unit.

The ambient light itself, originating from the sun or from headlights of a vehicle, may suffice to cause the road marking unit to light up and to render it visible. In an attractive embodiment of the road marking unit according to the invention a light generator is present in the housing. This renders it possible to cause the road marking unit to light up also while ambient light is absent. The light generator may comprise a light source accommodated in the housing, for example a semiconductor light source such as a light emitting diode, or a discharge lamp, for example a low-pressure discharge lamp such as a low-pressure mercury discharge lamp. In an attractive modification of this embodiment, the light generator comprises a first end of at least one light waveguide, which waveguide is optically coupled to a light source at a second, opposed end. The light source itself may be positioned at a distance from the road marking unit, so that this light source can be easily replaced, for example at the end of its useful life.

It is favorable in this modification when a transparent plate is arranged in a plane defined by the window, which plate is provided at an inward-facing surface with a relief having transverse surfaces which extend substantially perpendicularly to the plane defined by the window, while first ends of light waveguides are directed towards said transverse surfaces. It is possible by these means to generate a directional light beam, so that a good visibility of the road marking unit is realized with a comparatively low power.

The visibility of road marking units may be impaired by snow. An embodiment of the road marking unit according to the invention provided with a heater element renders it possible to melt away the snow locally. This also renders it possible to use components in the road marking unit which would not function at low temperatures.

It is noted that the state of the road marking unit need not correspond to the state of the optical switch. For example, an optical switch may be used which reflects in its deactivated state. The road marking unit would be in the activated state then.

The invention also relates to a road marking system provided with one or several road marking units according to the invention, with a control system for the road marking units, and with means for coupling the road marking units to the control system. The means for coupling the one or several road marking unit(s) to the control system may be constructed as a cable for the conduction of electrical or optical signals. In a modification, the coupling means are constructed as a remote control connection in the form of a transmitter/receiver pair, the transmitter transmitting control signals from the control system to a receiver accommodated in the road marking unit.

The electro-optical switch comprises, for example, an electrochromic material. In a practical embodiment, the electro-optical switch is provided with an electro-optical medium on the basis of liquid crystals. Such an electro-optical switch has a long life and is comparatively inexpensive. Depending on the type, optical properties of the electro-optical medium are influenced by means of an electric field. The electro-optical medium may comprise, besides the liquid crystals, also embedded substances such as coloring agents. Use is made, for example, of optical properties which can be influenced, such as the rotation of polarization, double refraction, dispersion, absorption, selective reflection. An overview of electro-optical switches provided with electro-optical mediums in the form of liquid crystals can be found, for example, in "Reflective LCDs for Low-Power Systems", T. Uchida, SID 96 Digest 96, pp. 31–34.

DETAILED DESCRIPTION OF THE PREFERRED EMBODIMENT

Figure 1:
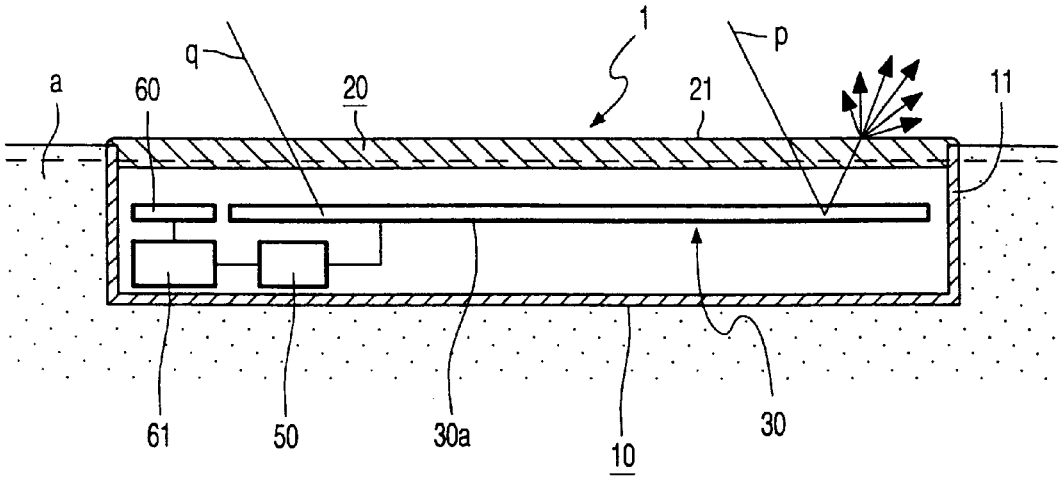
FIG. 1 shows a first embodiment of a road marking unit according to the invention.
Figure 1A:
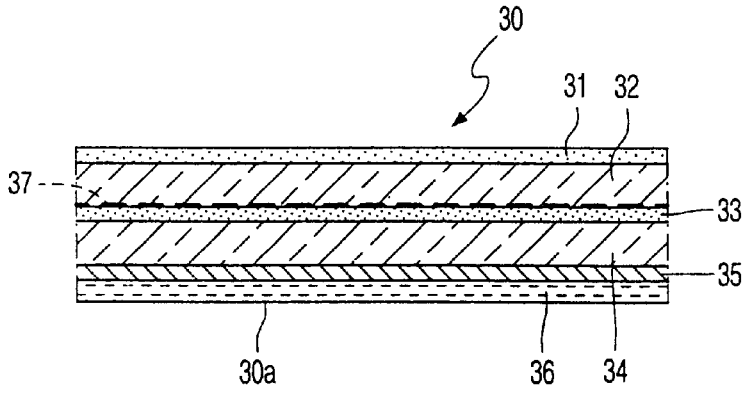
FIG. 1A shows a detail of a component of the road marking unit of FIG. 1.

FIG. 1 shows a road marking unit 1 comprising a housing 10 with a light-transmitting window 20. The road marking unit 1 is accommodated in a road surface a. An electro-optical switch 30 is accommodated in the housing 10 opposite the window 20. The electro-optical switch 30 reflects light emanating from the window towards the window 20 when the road marking unit is in an activated state. In a deactivated state of the road marking unit 1, the electro-optical switch 30 absorbs light traversing from the window 20. In the embodiment shown, the electro-optical switch 30 is provided with an electro-optical medium on the basis of liquid crystals. The electro-optical switch is shown in more detail in FIG. 1A. The electro-optical switch 30 shown is provided with a first and a second polarizer 31, 35, a first and a second support 32, 34 for a light-transmitting material, for example glass or a synthetic resin such as polyethylmethacrylate, and an electro-optical medium 33 comprising liquid crystals. A reflector, constructed as a reflecting layer 36 here, is provided at the surface 30*a* facing away from the window. The reflecting layer 36, made of aluminum in this case, at the same time serves as an electrode. It is possible to apply an electric field across the electro-optical medium 33, influencing optical properties thereof, by means of this reflecting electrode 36 and a further, light-transmitting electrode 37, for example constructed as a layer of tin-doped indium oxide. The electro-optical medium 33 operates in the twisted nematic mode in this case.

With the road marking unit 1 in the activated state p the electro-optical switch 30 will reflect light, for example sunlight, incident on the window 20, so that it is thrown back to the exterior again through the window 20. The road marking unit 1 is visible then. When the road marking unit 1 is in the deactivated state a however, the electro-optical switch will absorb light incident thereon through the window 20. The road marking unit then becomes visible.

The window 20 is provided with a protective layer 21, for example made of urethane resin or araldite, re-inforced with glass fibers. This gives the road marking unit 1 a rough upper surface, which promotes road safety. The protective layer 21 scatters the light thrown to the exterior, so that it is visible across a wide spatial angle.

The embodiment of the electro-optical switch 30 as shown can be operated by remote control. A receiver 50 is for this purpose arranged in the housing 10, which receiver brings the optical diaphragm 32 of the electro-optical switch 30 into its light-reflecting (activated) state or light-absorbing (de-activated) state. The receiver 50 is supplied by a battery 61 which is charged by means of a solar cell 60.

The housing 10 is constructed here as a box having walls 11 and a window 20. An alternative possibility is to encapsulate the components 30, 50, 60 and 61 of the road marking unit in a translucent material, for example a synthetic resin, which material then constitutes the housing.

Figure 2:
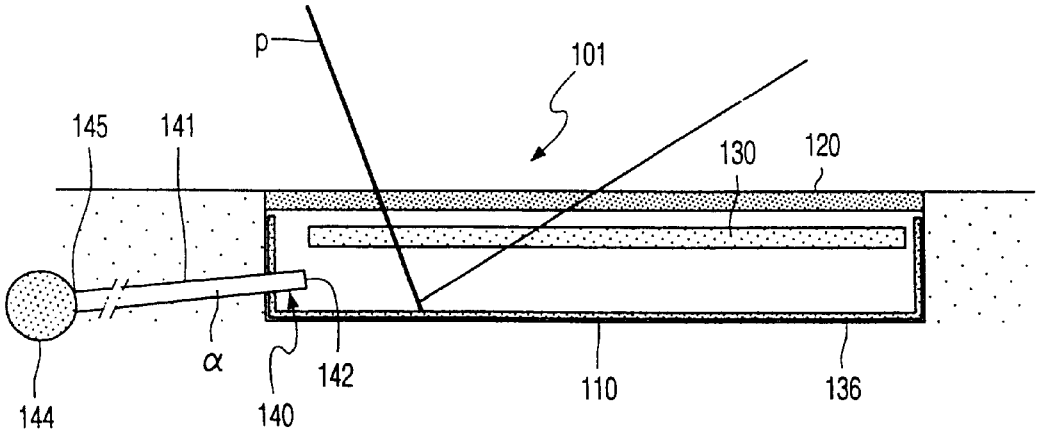
FIG. 2 shows a second embodiment.

FIG. 2 shows a second embodiment of the road marking unit according to the invention. Components therein corresponding to those in FIG. 1 have reference numerals which are 100 higher. The road marking unit of FIG. 2 has an electro-optical switch 130 which differs from that in FIG. 1 in that the reflecting electrode 36 is replaced by a light-transmitting electrode. A reflecting coating on an inner surface of the housing 110 here forms a reflector 136. A light generator 140 is in addition present in the embodiment shown. The light generator 140 here is a first end 142 of a light waveguide 141 which is arranged between the electrooptical switch 130 and the reflector 136. The light waveguide 141 is optically coupled to a light source 144 at its second, opposed end 145.

The electro-optical switch 130 transmits light when the road marking unit of FIG. 2 is in its activated state p. Light incident on the window 120 from the exterior in this state is reflected back to the exterior by the reflector 136. The light is absorbed in the electro-optical switch 130 when the road marking unit 101 is in the deactivated state. Since the light generator 142 is arranged between the reflector 136 and the electro-optical switch 130 in this embodiment, light originating from the light generator 142 is also absorbed in the deactivated state. This has the advantage that road marking units whose light waveguides are coupled to the same light source may still have mutually differing states.

Figure 3:
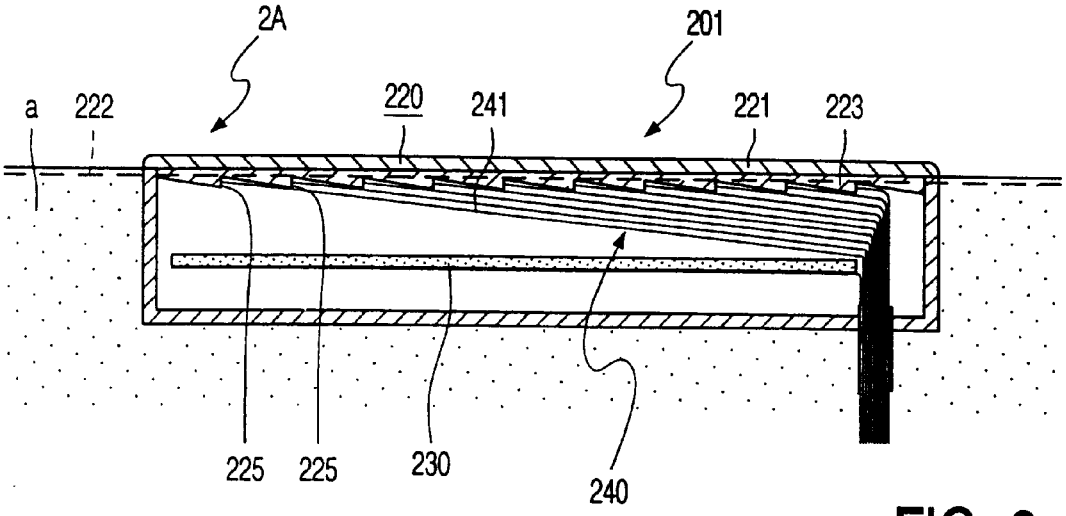
FIG. 3 shows a third embodiment.
Figure 3A:
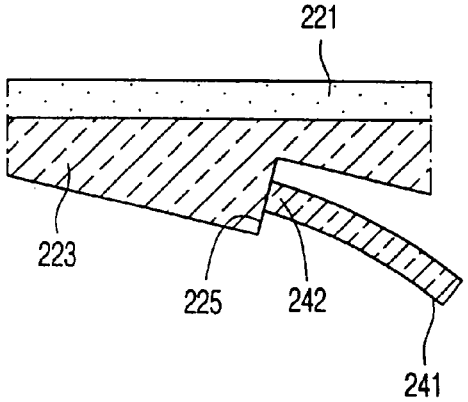
FIG. 3A shows a detail of a component of FIG. 3.

In a third embodiment shown in FIG. 3, components have reference numerals which are 100 higher than those of corresponding components in FIG. 2. A transparent plate 223 lying in a plane 222 defined by the window 220 forms part of the road marking unit of FIG. 3, which plate is provided with a sawtooth relief at its inward-facing surface. This relief is shown in more detail in FIG. 3A. The sawtooth relief has transverse surfaces 225 with an orientation which is substantially perpendicular to the plane 222 defined by the window 220. This plane 222 is substantially parallel to or coincides with the surface a of the road. A light generator is present between the window 220 and the electro-optical switch 230 in the embodiment of FIG. 3. The light generator 240 here comprises first ends 242 of light waveguides 241 directed towards the transverse surfaces 225 of the relief. The light waveguides 241 are optically coupled to a light source (not shown) by means of their second, opposed ends.

Figure 3B:
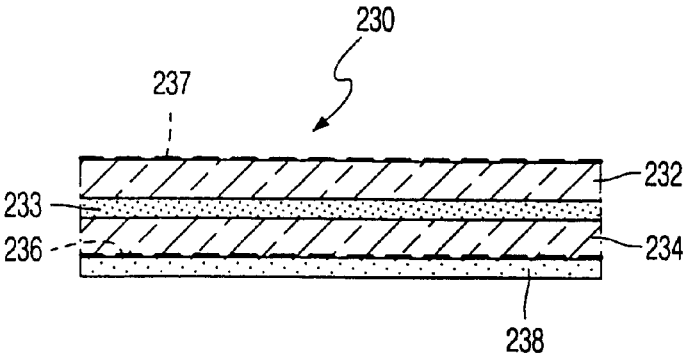
FIG. 3B shows a detail of a further component of FIG. 3.

The electro-optical switch 230 of the road marking unit of FIG. 3 is shown in more detail in FIG. 3B. Components therein corresponding to those in FIG. 1A have reference numerals which are 200 higher. The electro-optical switch 230 in FIG. 3B is provided with an electro-optical medium 233 on the basis of liquid crystals. The electro-optical medium 233 operates in the polymer dispersed liquid crystal mode (PDLC). The electrodes 236 and 237 are made of a light-transmitting material. A light-absorbing material 238 is provided on the electrode 236.

When the road marking unit 201 is in the activated state, the electro-optical medium 233 reflects light incident thereon through the window 220, so that the road marking unit 201 is visible. The visibility of the road marking unit 201 can be further enhanced under bad lighting conditions in that the light source coupled to the light waveguides 241 is switched on. In the deactivated state of the road marking unit 201, the electro-optical medium 233 transmits light incident thereon through the window 220, thus achieving that the light is absorbed by the absorbing layer 238, so that the road marking unit 201 is less visible.

Figure 4:
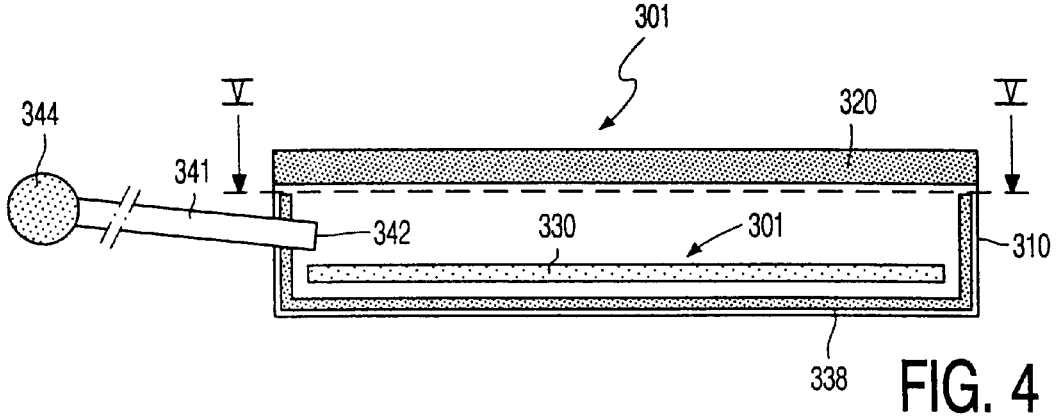
FIG. 4 shows a fourth embodiment.

A fourth embodiment is shown in FIG. 4. Components therein have reference numerals which are 100 higher than those of corresponding components in FIG. 3. The road marking unit shown has an electro-optical switch which operates in the PDLC mode, as does that in FIG. 3. The light-absorbing layer of the electro-optical switch, however, is provided on an inner surface of the housing 310, separately from the other components, in this case. The first end 342 of the light waveguide 341 is here arranged between the window 320 and the electro-optical switch 330.

Figure 5:
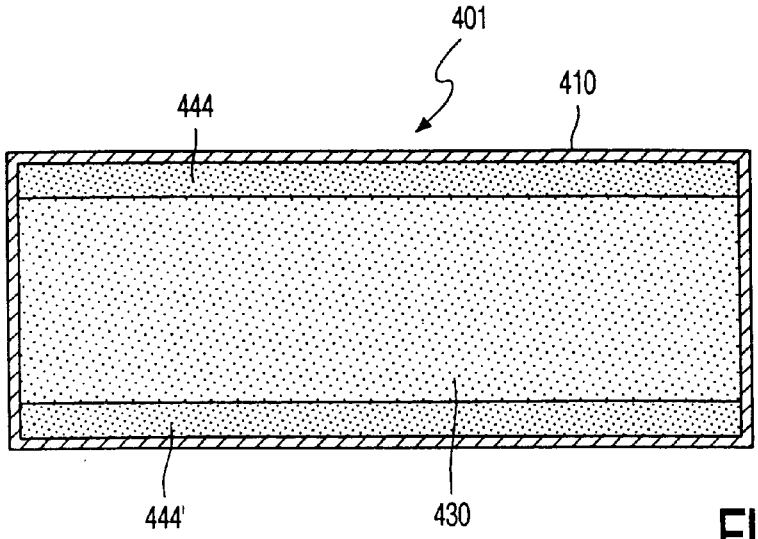
FIG. 5 shows a modification of the fourth embodiment in a cross-section taken on the line V—V in FIG. 4.

FIG. 5 shows a modification of the fourth embodiment of the road marking unit 401 according to the invention, in which light sources 444 and 444', for example low-pressure mercury discharge lamps, are accommodated in the housing 410. Components in FIG. 5 corresponding to those of FIG. 4 have reference numerals which are 100 higher.

Figure 6:
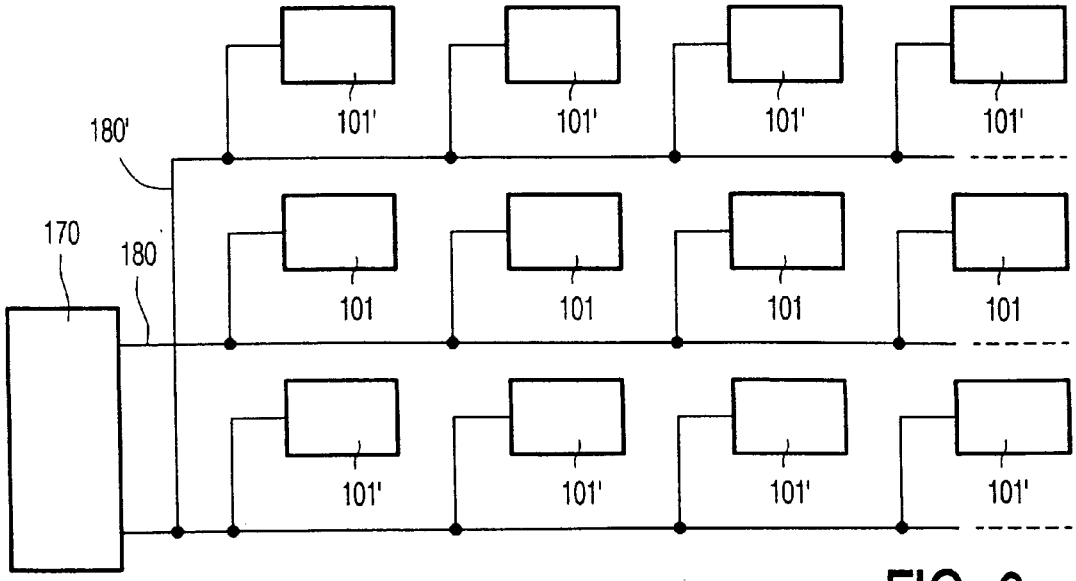
FIG. 6 shows a road marking system according to the invention.

FIG. 6 shows a road marking system provided with first road marking units 101 according to the invention, with a control system 170 for the road marking units, and with means 180 for coupling the first road marking units 101 to the control system 170. The road marking system is further provided with second road marking units 101' and with means 180'for coupling the second road marking units 101' to the control system 170. The means 180 and 180' here comprise cables for the conduction of electrical signals.

It will be obvious that within the scope of the invention many variations are possible to those skilled in the art.

The invention is embodied in each now characteristic and each combination of characteristics.

What is claimed is:

1. A road marking unit comprising a housing with a light-transmitting window, and an electro-optical switch accommodated in the housing, which switch in an activated state reflects light entering from the window back towards the window, and in a deactivated state absorbs light entering from the window.

2. A road marking unit as in claim 1 wherein the electro-optical switch comprises an electro-optical medium on the basis of liquid crystals.

3. A road marking unit as in claim 1 further comprising a light generator which emits light in the housing.

4. A road marking unit as in claim 3 wherein the light generator comprises a light waveguide having a first end in the housing and a second opposed end which is optically coupled to a light source.

5. A road marking unit as in claim 4 further comprising a transparent plate arranged in a plane defined by the window, said plate having an inward-facing surface provided with a relief having transverse surfaces which extend substantially perpendicularly to the plane defined by the window, said first end of said light waveguide being directed towards said transverse surfaces.

6. A road marking unit as in claim 1 further comprising a receiver in the housing for remote control of the electro-optical switch, and a solar cell in the housing for supplying power to the receiver and the electro-optical switch.

7. A road marking system provided comprising at least one road marking unit as in claim 1, a control system for the road marking unit, and means for coupling the road marking unit to the control system.

* * * * *